US006780027B2

(12) United States Patent
Allison

(10) Patent No.: US 6,780,027 B2
(45) Date of Patent: Aug. 24, 2004

(54) POWER CONNECTOR WITH VERTICAL MALE AC POWER CONTACTS

(75) Inventor: Jeffrey W. Allison, Etters, PA (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 10/352,584

(22) Filed: Jan. 28, 2003

(65) Prior Publication Data

US 2004/0147144 A1 Jul. 29, 2004

(51) Int. Cl.[7] ..... H01R 12/00
(52) U.S. Cl. ..... 439/79; 439/907; 439/507
(58) Field of Search ..... 439/74, 79, 507, 439/510, 907

(56) References Cited

U.S. PATENT DOCUMENTS

| | | | | |
|---|---|---|---|---|
| 3,596,235 A | * | 7/1971 | Teurlings | 439/907 |
| 3,750,092 A | | 7/1973 | Bury | 339/192 RL |
| 3,789,348 A | | 1/1974 | Lenaerts et al. | 339/198 R |
| 3,910,671 A | | 10/1975 | Townsend | 339/97 R |
| 3,944,312 A | | 3/1976 | Koenig | 339/59 R |
| 4,227,762 A | | 10/1980 | Scheiner | 339/91 R |
| 4,322,120 A | * | 3/1982 | Rilling | 439/907 |
| 4,626,637 A | | 12/1986 | Olsson et al. | 200/284 |
| 4,659,158 A | | 4/1987 | Sakamoto et al. | 339/19 |
| 4,669,801 A | | 6/1987 | Worth | 439/404 |
| 4,685,886 A | | 8/1987 | Denlinger et al. | 439/55 |
| 4,709,976 A | | 12/1987 | Nakama et al. | 439/350 |
| 4,790,763 A | | 12/1988 | Weber et al. | 439/65 |
| 4,790,764 A | | 12/1988 | Kawaguchi et al. | 439/78 |
| 4,838,809 A | | 6/1989 | Mouissie | 439/155 |
| 4,845,592 A | | 7/1989 | Himes, Jr. et al. | 361/407 |
| 4,875,865 A | | 10/1989 | Demler, Jr. et al. | 439/101 |
| 4,881,905 A | | 11/1989 | Demler, Jr. et al. | 439/79 |
| 4,900,271 A | | 2/1990 | Colleran et al. | 439/595 |
| 4,941,830 A | | 7/1990 | Tkazyik et al. | 439/59 |
| 4,950,186 A | | 8/1990 | Kaley et al. | 439/882 |
| 4,954,090 A | | 9/1990 | Shimochi | 439/76 |
| 4,968,263 A | | 11/1990 | Silbernagel et al. | 439/246 |
| 5,139,426 A | | 8/1992 | Barkus et al. | 439/65 |
| 5,152,700 A | | 10/1992 | Boguresky et al. | 439/733 |
| 5,158,471 A | | 10/1992 | Fedder et al. | 439/80 |

(List continued on next page.)

FOREIGN PATENT DOCUMENTS

| | | |
|---|---|---|
| EP | 0 465 013 | 1/1992 |
| EP | 0 724 313 | 7/1996 |
| GB | 2 168 550 | 6/1986 |
| JP | 09 055 245 | 2/1997 |

OTHER PUBLICATIONS

FCI, "PwrBlade® Power Distribution Connector System," 2003, www.fciconnect.com, 2 pages.
FCI, "PwrBlade® Power Distribution Connector System," *Technology Innovation Service*, 2003, 2–3.
FCI, "PwrBlade™, new Power Distribution connector for electronic applications," *Product News*, 2003, www.fciconnect.com, 1 page.
FCI, "Act Connectors in action," *Panorama*, 2003, 1 page.
U.S. patent application Ser. No. 09/944,266, Schell, filed Aug. 31, 2001.

*Primary Examiner*—Tho D. Ta
(74) *Attorney, Agent, or Firm*—Woodcock Washburn LLP

(57) ABSTRACT

Electrical connectors are provided for transmitting electrical power. A preferred connector comprises an insulative housing and a plurality of AC power contacts disposed therein. The insulative housing comprises a circuit board facing portion and a mating face including a plurality of apertures. Each of the AC power contacts comprises an engaging portion accessible through one of the apertures for engagement with a complementary contact associated with a mating connector. A tab extends from the engaging portion of each of the AC power contacts that protrudes from the insulative housing at a position farthest from the circuit board facing portion for engagement with an AC cable plug.

23 Claims, 4 Drawing Sheets

U.S. PATENT DOCUMENTS

| | | | | | |
|---|---|---|---|---|---|
| 5,207,591 | A | | 5/1993 | Ozaki et al. | 439/212 |
| 5,281,168 | A | | 1/1994 | Krehbiel et al. | 435/595 |
| 5,295,843 | A | | 3/1994 | Davis et al. | 439/108 |
| 5,358,422 | A | | 10/1994 | Schaffer et al. | 439/346 |
| 5,362,249 | A | | 11/1994 | Carter | 439/357 |
| 5,376,012 | A | | 12/1994 | Clark | 439/80 |
| 5,403,206 | A | | 4/1995 | McNamara et al. | 439/608 |
| 5,549,480 | A | | 8/1996 | Cheng | 439/79 |
| 5,582,519 | A | | 12/1996 | Buchter | 439/101 |
| 5,590,463 | A | | 1/1997 | Feldman et al. | 29/844 |
| 5,618,187 | A | | 4/1997 | Goto | 439/79 |
| 5,622,511 | A | | 4/1997 | Jarrett | 439/248 |
| 5,643,013 | A | | 7/1997 | Weidler et al. | 439/660 |
| 5,667,392 | A | | 9/1997 | Kocher et al. | 439/79 |
| 5,716,234 | A | | 2/1998 | Phillips | 439/595 |
| 5,772,452 | A | * | 6/1998 | Aoyama | 439/79 |
| 5,785,557 | A | | 7/1998 | Davis | 439/660 |
| 5,865,651 | A | | 2/1999 | Dague et al. | 439/680 |
| 5,904,594 | A | | 5/1999 | Lougueville et al. | 439/608 |
| 5,924,899 | A | | 7/1999 | Paagman | 439/701 |
| 6,027,360 | A | | 2/2000 | Jenkins | 439/364 |
| 6,190,215 | B1 | | 2/2001 | Pendleton et al. | 439/853 |
| 6,319,075 | B1 | | 11/2001 | Clark et al. | 439/825 |
| 6,358,094 | B1 | | 3/2002 | Belopolsky et al. | 439/637 |
| 6,394,818 | B1 | | 5/2002 | Smalley, Jr. | 439/79 |
| 6,511,329 | B2 | * | 1/2003 | Yi-Tsung | 439/76.1 |
| 2001/0000498 | A1 | * | 4/2001 | Watanabe et al. | 439/507 |

* cited by examiner-

POWER CONNECTOR WITH VERTICAL MALE AC POWER CONTACTS

FIELD OF THE INVENTION

The present invention is related to connectors for transmitting electrical power.

BACKGROUND OF THE INVENTION

There has been significant evolution in the area of electrical connectors, with improvements including multi-function consolidation within a single connector housing, and employment of features for effective heat dissipation generated from electrical power transmission. For example, Clark et al., in U.S. Pat. No. 6,319,075, disclose an electrical connector including both power and signal contacts within a single insulative housing, thereby eliminating the need for two separate connectors. Preferred power contacts disclosed in the '075 patent employ a "dual-mass" principle that provides a greater surface area available for heat dissipation, as compared to "single-mass" designed contacts, such as, for example, those having a circular or pin-like cross section.

Electrical connectors similar to those above may further comprise an AC power cable port and AC power contacts for direct connection with an external power supply. Examples of such connectors are commercially available from FCI Electronics, Inc. FCI's PWRBLADE brand connector series includes a receptacle connector that consists of AC power contacts, DC power contacts, signal contacts, and a shrouded AC cable port. Each of the power contacts includes two contact walls with a space therebetween to facilitate heat dissipation. Two patent applications owned by the assignee of the instant application and generally related to power distribution connectors, U.S. patent application Ser. Nos. 09/160,900 filed Sep. 25, 1998 and 09/944,266 filed Aug. 31, 2001, are currently pending in the U.S. Patent & Trademark Office, and are incorporated by reference herein.

Although a useful contribution to the art, the AC power contacts and AC cable port in applicant's co-pending '266 patent extend from and terminate at the rear portion of the connector housing. Valuable circuit board space to which the connector is coupled is compromised with this connector configuration because space and access must be provided for an AC power cable plug that engages the AC power contacts. This configuration also increases the possibility of electrical creepage due to the close proximity between the circuit board and the AC cable port and a corresponding AC power cable plug. Accordingly, there is room for improvement in the art.

SUMMARY OF THE INVENTION

The present invention is related to electrical connectors having contacts for transmitting electrical power. In accordance with a preferred embodiment of the present invention, there has now been provided an electrical power connector comprising an insulative housing and a plurality of AC power contacts disposed in the insulative housing. The insulative housing comprises a circuit board facing portion and a mating face including a plurality of apertures therein. Each of the AC power contacts comprises an engaging portion accessible through one of the plurality of apertures for engagement with a complementary contact, and a tab extending from the engaging portion and protruding from the insulative housing at a position farthest from the circuit board facing portion for engagement with an AC cable plug.

In accordance with another preferred embodiment of the present invention, there has now been provided a an electrical power connector comprising an insulative housing, a DC power contact disposed in the insulative housing, and an AC power contact disposed in the insulative housing. The insulative housing comprises a mating face including a plurality of apertures therein. The DC power contact includes an engaging portion that is accessible through one of the plurality of apertures and is configured for engagement with a contact from a mating connector, and at least one terminal extending from the engaging portion for connection to a circuit board. The AC power contact includes an engaging portion that is accessible through another of the plurality of apertures and is configured for engagement with a contact from a mating connector, and a tab extending from the engaging portion for engagement with an AC cable plug. The at least one terminal and the tab extend in opposite directions.

In accordance with yet another preferred embodiment of the present invention, there has now been provided an electrical power connector comprising an insulative housing, a plurality of AC power contact disposed in the housing, and a shrouded AC cable port. The insulative housing comprises a top portion, a bottom portion, and a mating face extending therebetween. The mating face includes a plurality of apertures therein for receiving contacts from a mating connector. Each of the AC power contacts includes an engaging portion comprising two spaced apart walls that are accessible through one of the plurality of apertures and a tab extending from only one of the two spaced apart walls. The shrouded AC cable port extends from the top portion of the insulative housing, encompasses the AC power contact tabs, and is configured for receiving an AC cable plug.

These and various other features of novelty, and their respective advantages, are pointed out with particularity in the claims annexed hereto and forming a part hereof. However, for a better understanding of aspects of the invention, reference should be made to the drawings which form a further part hereof, and to the accompanying descriptive matter, in which there is illustrated preferred embodiments.

DETAILED DESCRIPTION OF PREFERRED EMBODIMENTS

Figure 1:
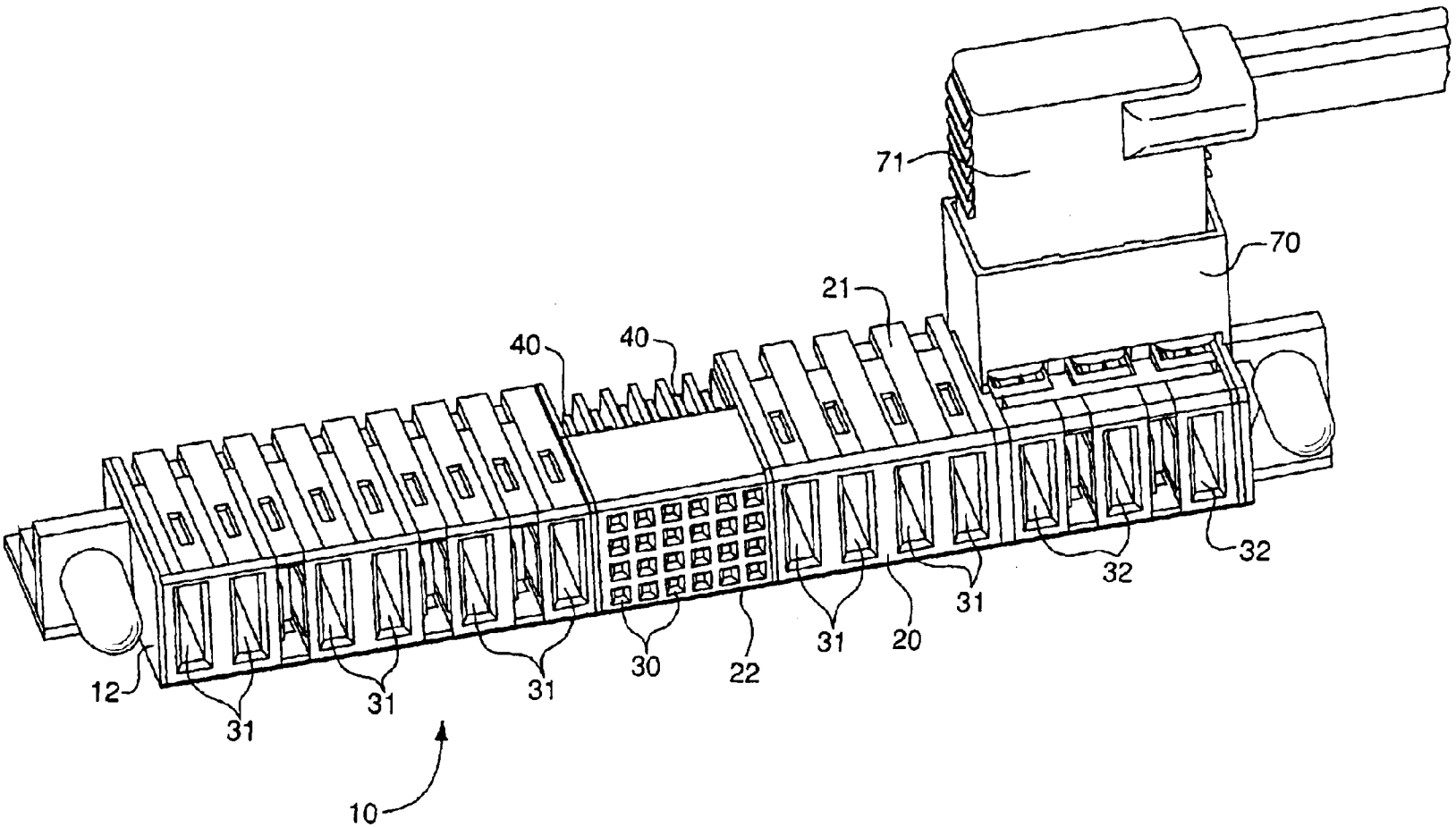
FIG. 1 is a perspective view of a preferred connector embodiment provided by the present invention, with a power cable plug engaged therewith.
Figure 2:
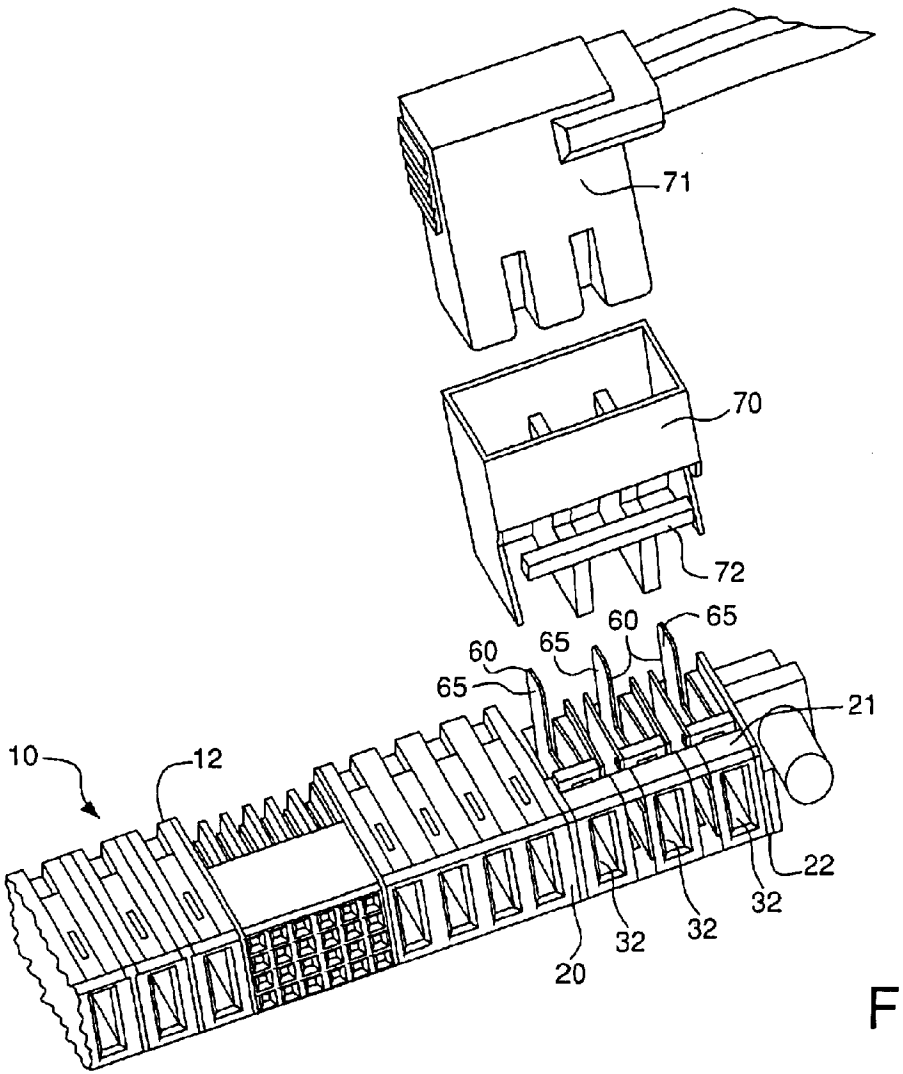
FIG. 2 is a partial, exploded view of the connector embodiment shown in FIG. 1.

The present invention is believed to be best understood through the following detailed description of preferred embodiments and the accompanying drawings wherein like reference numbers indicate like features. Referring to FIGS. 1 and 2, an electrical power connector 10 is shown including an insulative housing 12 having a mating face 20 for receiving a complimentary electrical connector (not shown). Mating face 20 contains a plurality of apertures that provide access to electrical contacts disposed in insulative housing 12. For example, apertures 30 provide access to engaging portions of signal contacts 40, apertures 31 provide access to engaging portions of DC power contacts 50 (shown in FIG. 5), and apertures 32 provide access to engaging portions of AC power contacts 60 (details shown in FIGS. 3A–3C). Although the number and arrangement of the various apertures is identical in all of the figures herein, connectors covered by the appended claims may have any number of apertures and corresponding electrical contacts that are arranged in various configurations.

Mating face 20 spans between a top portion 21 and an opposing circuit board facing portion 22 of insulative housing 12. A shrouded AC cable port 70 extends from top portion 21, and is shown with an external power source, AC cable plug 71, received therein. As can be seen from FIG. 2, AC cable port 70 encompasses tabs 65 associated with the individual AC power contacts 60, and has an optional locking bar 72 that helps to retain the position of the AC power contacts 60 within insulative housing 12 when AC cable plug 71 is disengaged from tabs 65 (that is, when the external AC power source is removed from the connector).

Shrouded AC cable port 70 extends from top portion 21 such that the AC power contact tabs 65 can protrude from insulative housing 12 at a position farthest from the circuit board facing portion 22. This configuration helps to eliminate mechanical and electrical interference of the external AC power supply with the circuit board. If tabs 65 and AC cable port 70 extended from other portions of insulative housing 12, such as a rear portion (not shown), then valuable board space would be compromised due to the physical space taken up by an engaged AC cable plug 71 and the additional space required for engagement and disengagement of the relatively large plug. Moreover, the probability of electrical interference or electrical creepage increases the closer an external AC power supply gets to a circuit board to which connector 10 is connected.

Figure 3C:
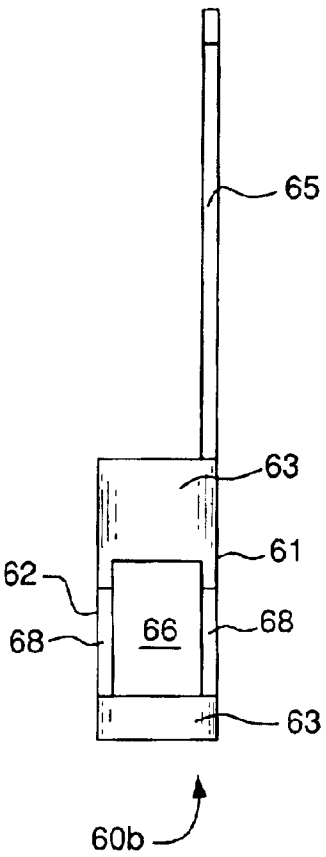
FIG. 3C is a rear view of the AC power contact embodiment shown in FIG. 3B.
Figure 3B:
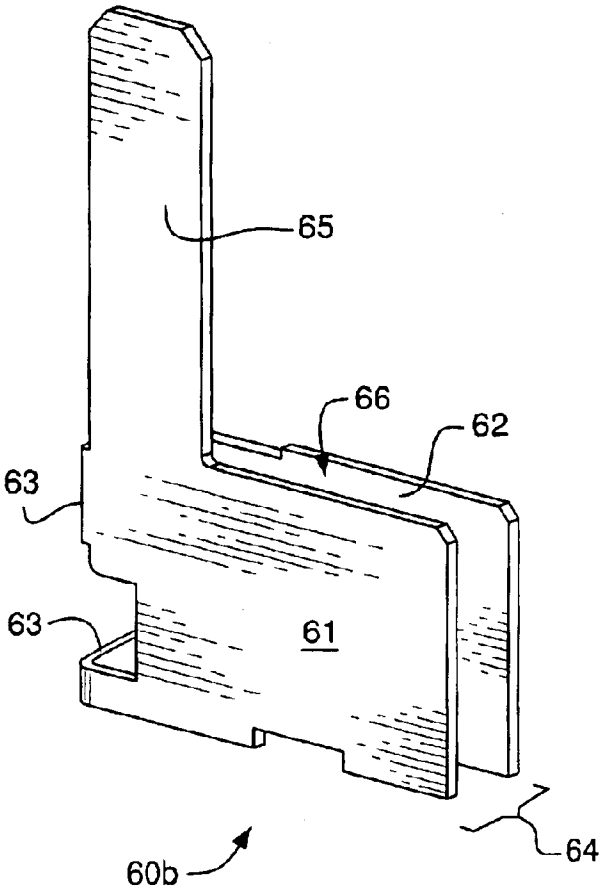
FIG. 3B is a perspective view of another preferred AC power contact embodiment provided by the present invention.
Figure 3A:
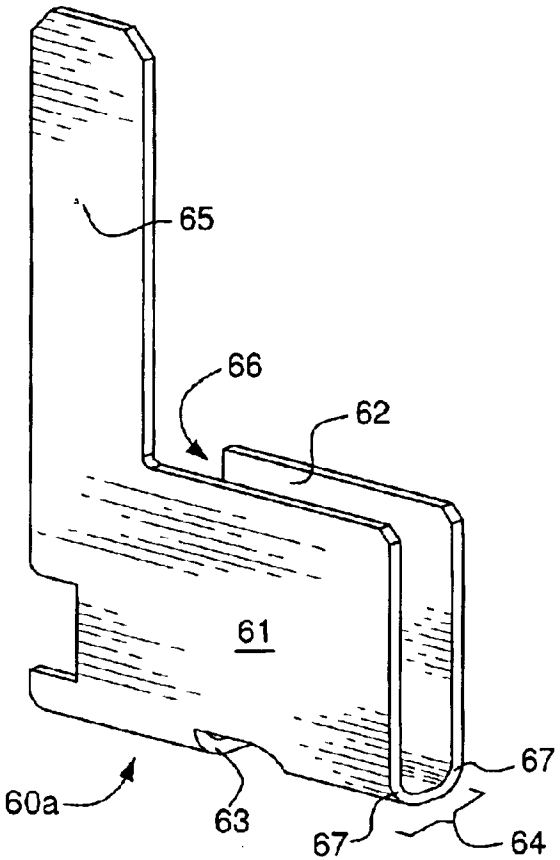
FIG. 3A is a perspective view of a preferred AC power contact embodiment provided by the present invention.

A variety of exemplary AC power contact designs are provided that are suitably employed in the connector configuration described above. Referring now to FIGS. 3A–3C, two preferred AC power contact embodiments are shown. AC power contacts 60*a* and 60*b* each comprise two spaced apart contact walls 61 and 62 connected by one or more bridging members 63. Contact walls 61 and 62 define an engaging portion 64 that is accessible through corresponding apertures 32 located on mating face 20. Contacts associated with a mating electrical connector (not shown) enter apertures 32 and engage contact walls 61 and 62. Employing two contact walls can increase the electrical integrity of power connector 10. Also, the two contact walls 61, 62 in conjunction with intermediate space 66, which allows for airflow between contact walls 61, 62, increases the ability and rate to dissipate heat generated by power transmission. The difference between the two preferred AC power contact embodiments, is that contact walls 61 and 62 are connected at their bottom edges 67 in AC power contact 60*a*, and are connected at their rear edges 68 in AC Power contact 60*b*.

Each of AC power contacts 60*a* and 60*b* further comprises tab 65 extending upwardly from a single contact wall 61 for engaging AC cable plug 71. A reduction in manufacturing costs can be realized by employing only a single tab 65. Quality issues can also be avoided by employing a single tab 65 because a requirement to "match up" two tabs, one tab extending from each spaced apart contact wall 61 and 62 for proper engagement with an AC cable plug, is completely eliminated. AC power contacts contemplated by the present invention, however, may comprise a tab extending from both contact walls.

Figure 4:
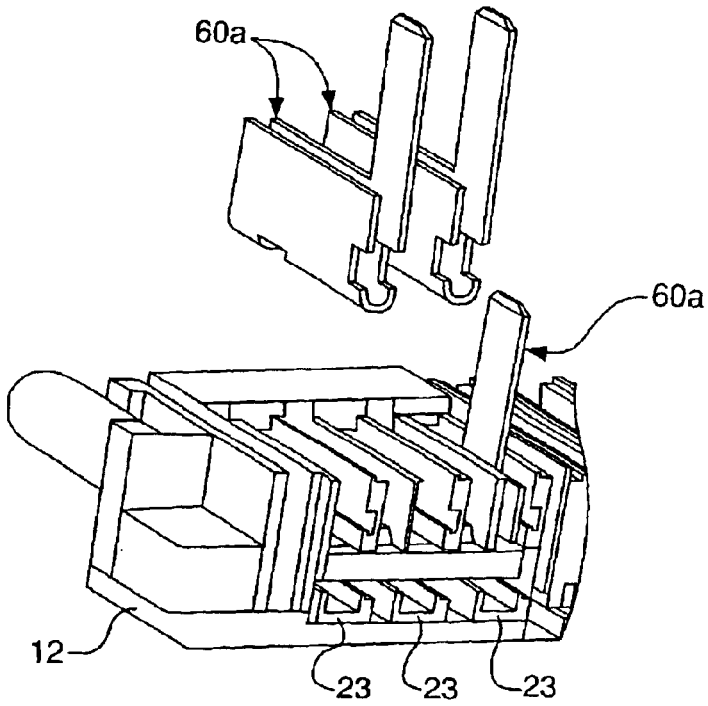
FIG. 4 is a partial, rear perspective view of a connector embodiment illustrating AC power contacts being loaded into the connector housing.

Referring now to FIG. 4, three exemplary AC power contacts 60*a* are shown being loaded into connector 10. A portion 23 of insulative housing 12 underlies each of the AC power contacts to define a gap between connector 10 and a circuit board (not shown) to which the connector is connected so that electrical creepage is minimized.

Figure 5:
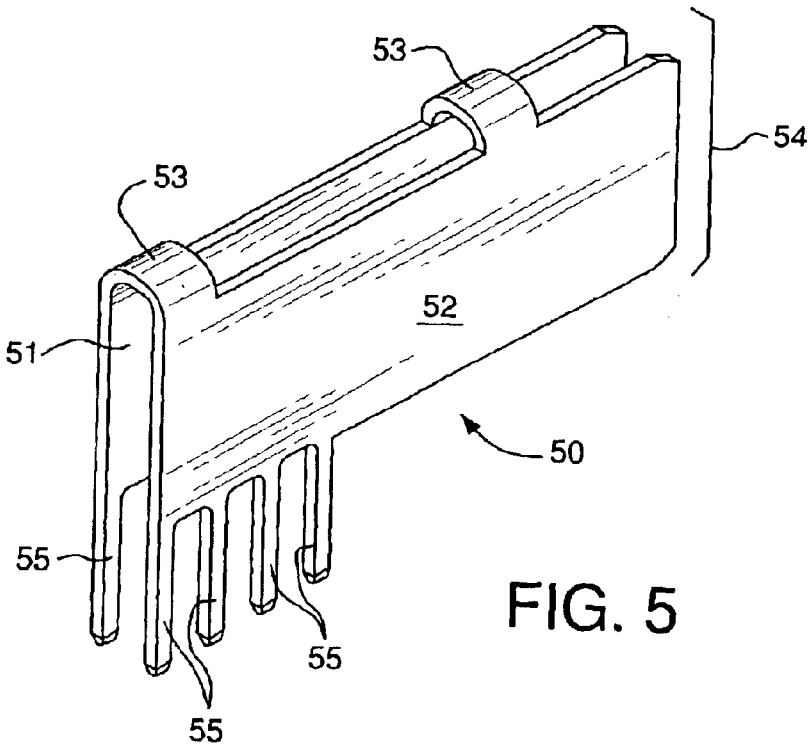
FIG. 5 is a perspective view of a preferred DC power contact embodiment provided by the present invention.

A preferred DC power contact 50 is shown in FIG. 5, including two spaced apart contact walls 51 and 52 that define an engaging portion 54 are connected by two bridging members 53. A single bridging member, extending along a minor or major portion of the contact walls 51, 52, is also contemplated. This DC power contact configuration provides similar benefits to those described above in conjunction with the preferred AC power contact embodiments. A plurality of terminals 55 extend downwardly from contact walls 51 and 52 for connection to a circuit board. Thus, with power contacts 50 and 60 disposed within housing 12, terminals 55 extend in a direction that is opposite from tabs 65. Or in other words, terminals 55 associated with DC power contacts 50 protrude from circuit board facing portion 22 of housing 12, and tabs 65 associated with AC power contacts 60 protrude from top portion 21 of housing 12.

The contact walls and/or bridging element of the AC and DC power contacts, 60 and 50 respectively, may contain notches or other female elements, and/or tangs or other male elements for retaining the power contacts in housing 12. Preferred power contacts are stamped or otherwise formed as single piece from suitable materials such as phosphor bronze alloys or beryllium copper alloys. Signal contacts 40 (shown in FIG. 1 disposed in housing 12) are preferably "pin-type" contacts that include tail portions for connection with a circuit board, and are made from suitable materials, such as, for example, copper alloys. The power and signal contacts may be plated with gold, or a combination of gold and nickel.

Housing 12 and shrouded AC cable port 70 are preferably molded or formed from a glass-filled high temperature nylon or other materials known to one having ordinary skill in the art AC cable port 70 may be integrally molded with housing 12, or alternatively, be manufactured separately and then coupled to housing 12.

It is to be understood that even though numerous characteristics and advantages of the present invention have been set forth in the foregoing description, together with details of the structure and function of the invention, the disclosure is illustrative only. Accordingly, changes may be made in detail, especially in matters of shape, size and arrangement of features within the principles of the invention to the full extent indicated by the broad general meaning of the terms in which the appended claims are expressed.

What is claimed:

1. An electrical power connector, comprising:

an insulative housing comprising a circuit board facing portion and a mating face including a plurality of apertures therein;

a plurality of DC power contacts disposed in the insulative housing; and a plurality of AC power contacts disposed in the insulative housing, each of the AC power contacts comprising an engaging portion accessible through one of the plurality of apertures for engagement with a complementary contact, and a tab extending from the engaging portion and protruding from the insulative housing at a position farthest from the circuit board facing portion for engagement with an AC cable plug.

2. The connector of claim 1, wherein each of the DC power contacts comprises two spaced apart walls and a terminal extending from at least one of the two spaced apart walls for connection to a circuit board.

3. The connector of claim 1, further comprising a plurality of signal contacts.

4. The connector of claim 1, further comprising a plurality of signal contacts.

5. The connector of claim 1, further comprising a shrouded port for shielding the AC power contact tabs and for receiving an AC cable plug.

6. The connector of claim 1, wherein each of the AC power contacts comprises two spaced apart walls.

7. The connector of claim 6, wherein the tab extends from only one of the two spaced apart walls.

8. The connector of claim 6, wherein the two spaced apart walls are coupled by a bridging member.

9. The connector of claim 8, wherein the bridging member couples the bottom edges of the two spaced apart walls.

10. The connector of claim 8, wherein the bridging member couples the rear edges of the two spaced apart walls.

11. An electrical power connector, comprising:

an insulative housing comprising a mating face including a plurality of apertures therein; and a DC power contact disposed in the insulative housing including an engaging portion that is accessible through one of the plurality of apertures and is configured for engagement with a contact from a mating connector, and at least one terminal extending from the engaging portion for connection to a circuit board; and an AC power contact disposed in the insulative housing including an engaging portion that is accessible through another of the plurality of apertures and is configured for engagement with a contact from a mating connector, and a tab extending from the engaging portion for engagement with an AC cable plug;

wherein the at least one terminal and the tab extend in opposite directions.

12. The connector of claim 11, wherein the engaging portion of the DC power contact comprises two spaced apart walls.

13. The connector of claim 11, further comprising at least one signal contact disposed in the insulative housing.

14. The connector of claim 11, wherein a portion of the insulative housing underlies the AC power contact to prevent electrical creepage between the connector and a circuit board to which the connector is connected.

15. The connector of claim 11, wherein a direction for interconnecting the connector with a mating connector is orthogonal to the direction the AC power contact terminal extends.

16. The connector of claim 11, wherein the engaging portion of the AC power contact comprises two spaced apart walls.

17. The connector of claim 16, wherein the tab extends from only one of the two spaced apart walls.

18. An electrical power connector, comprising:

an insulative housing comprising a top portion, a bottom portion, and a mating face extending therebetween; the mating face including a plurality of apertures therein for receiving contacts from a mating connector;

a plurality of AC power contacts disposed in the insulative housing, each of the AC power contacts including an engaging portion comprising two spaced apart walls that are accessible through one of the plurality of apertures and a tab extending from only one of the two spaced apart walls; and a shrouded AC cable port extending from the top portion of the insulative housing that encompasses the AC power contact tabs and is configured for receiving an AC cable plug.

19. The connector of claim 18, further comprising a plurality of DC power contacts disposed in the insulative housing.

20. The connector of claim 19, wherein each of the DC power contacts comprises two spaced apart walls.

21. The connector of claim 19, further comprising a plurality of signal contacts disposed in the insulative housing.

22. An electrical power connector, comprising:

an insulative housing comprising a circuit board facing portion and a mating face including a plurality of apertures therein; and a plurality of AC power contacts disposed in the insulative housing, each of the AC power contacts comprising an engaging portion accessible through one of the plurality of apertures for engagement with a complementary contact, and a tab extending from the engaging portion and protruding from the insulative housing at a position farthest from the circuit board facing portion for engagement with an AC cable plug; and a plurality of signal contacts disposed in the insulative housing.

23. An electrical power connector, comprising:

an insulative housing comprising a circuit board facing portion and a mating face including a plurality of apertures therein; and a plurality of AC power contacts disposed in the insulative housing, each of the AC power contacts comprising an engaging portion accessible through one of the plurality of apertures for engagement with a complementary contact, and a tab extending from the engaging portion and protruding from the insulative housing at a position farthest from the circuit board facing portion for engagement with an AC cable plug; and a shrouded port for shielding the AC power contact tabs and for receiving an AC cable plug.

* * * * *